US006751293B1

(12) United States Patent
Barrett

(10) Patent No.: US 6,751,293 B1
(45) Date of Patent: Jun. 15, 2004

(54) ROTARY COMPONENT SUPPORT SYSTEM

(75) Inventor: Vaughn Leroy Barrett, West Jordan, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 141 days.

(21) Appl. No.: 09/971,472

(22) Filed: Oct. 5, 2001

(51) Int. Cl.[7] ..... H01J 35/10

(52) U.S. Cl. ..... 378/144; 378/121; 378/122; 378/125

(58) Field of Search ..... 378/121, 122, 378/125, 144; 464/184, 182; 403/263, 334, 350, 409.1

(56) References Cited

U.S. PATENT DOCUMENTS 3,795,832 A * 3/1974 Holland ..... 313/60
3,855,492 A 12/1974 Langer et al.
4,141,606 A 2/1979 Yamamura
4,272,696 A 6/1981 Stroble et al.
4,670,895 A 6/1987 Penato et al.
4,949,368 A 8/1990 Kubo
5,085,619 A * 2/1992 Torii et al. ..... 474/138
5,303,280 A 4/1994 Crawford et al.
5,308,172 A 5/1994 Upadhya et al.
5,357,552 A 10/1994 Kutschera
5,425,067 A 6/1995 Sano et al.
5,498,186 A 3/1996 Benz et al.
5,588,035 A 12/1996 Christean et al.
5,593,258 A * 1/1997 Matsumoto et al. ..... 409/234
5,655,000 A 8/1997 Benz et al.
5,696,808 A * 12/1997 Lenz ..... 378/121
5,699,401 A 12/1997 Jackson et al.
5,838,762 A 11/1998 Ganin et al.
5,875,227 A 2/1999 Bhatt
6,088,426 A 7/2000 Miller
6,125,168 A 9/2000 Bhatt
6,603,834 B1 * 8/2003 Lu et al. ..... 378/141

* cited by examiner

*Primary Examiner*—Craig E. Church
*Assistant Examiner*—Jurie Yun
(74) *Attorney, Agent, or Firm*—Workman Nydegger

(57) ABSTRACT

A rotary component support system for positioning and securing an anode of x-ray tube. The rotary component support system includes a shaft, to which the anode is indirectly mounted, that includes a tapered end and defines a threaded hole. The tapered end of the shaft is engaged by a tapered cavity defined by a mounting piece that is disposed in an aperture defined by the vacuum enclosure of the x-ray tube. The mounting piece defines a hole through which a bolt passes. The bolt engages the threaded hole defined by the support shaft so that as the bolt is tightened, the tapered end of the support shaft is drawn into the tapered cavity of the mounting piece. Due to the tapered geometries, the support shaft self-aligns itself with respect to the mounting piece. A weld at the interface between the bolt and the mounting piece seals the vacuum enclosure.

12 Claims, 3 Drawing Sheets

ROTARY COMPONENT SUPPORT SYSTEM

BACKGROUND OF THE INVENTION

1. The Field of the Invention

The present invention generally relates to support systems for use in conjunction with components designed for rotary motion. More particularly, the present invention relates to a rotary component support system for a rotating anode of an x-ray tube.

2. Related Technology

X-ray generating devices are extremely valuable tools that are used in a wide variety of applications, both industrial and medical. For example, such equipment is commonly employed in areas such as medical diagnostic examination and therapeutic radiology, semiconductor fabrication, and materials analysis.

Regardless of the applications in which they are employed, most x-ray generating devices operate in a similar fashion. X-rays are produced in such devices when electrons are accelerated to high speeds and then impinged upon a material of a particular composition. This process typically takes place within an evacuated housing of an x-ray tube located in the x-ray generating device. The x-ray tube includes an electron source, or cathode, and an anode oriented to receive electrons emitted by the cathode. The anode, which typically comprises a graphite substrate and a heavy metallic target surface, can be stationary within the tube, or can be in the form of a rotating disk supported by a bearing assembly and a support shaft.

In operation, an electric current is supplied to a filament portion of the cathode, causing it to emit a stream of electrons by thermionic emission. A high electric potential placed between the cathode and anode causes the electron stream to accelerate toward a target surface located on the anode. Upon striking the target surface, some of the resulting kinetic energy is released as electromagnetic radiation of very high frequency, i.e., x-rays. The specific frequency of the x-rays produced depends in large part on the type of material used to form the anode target surface. Target surface materials having high atomic numbers ("Z numbers"), such as tungsten, are typically employed. The x-rays ultimately exit the x-ray device through a window formed in the x-ray tube housing so as to interact in or on material samples or patients. As is well known, the x-rays can be used for sample analysis procedures, therapeutic treatment, or in medical diagnostic procedures.

In general, only a small portion of the kinetic energy contained in the electron stream is converted into x-rays. A majority of the energy is dissipated as heat in the anode target region and the rest of the anode. This heat can reach extremely high temperatures that can damage the anode structure over time, and can reduce the operating life of the x-ray tube and/or the performance and operating efficiency of the tube. To help alleviate this problem, the x-ray target, or focal track, is typically positioned on an annular portion of a rotatable anode disk. Typically, the anode disk (also referred to as the rotary target or the rotary anode) is mounted on a supporting shaft which, in turn, is supported by bearings contained a bearing housing. The shaft and disk are then appropriately connected to and rotated by a motor.

When the anode is rotated, the focal track is rotated into and out of the path of the electron beam. In this way, the electron beam is in contact with specific points along the focal track for only short periods of time, thereby allowing the remaining portion of the track to cool during the time that it takes the portion to rotate back into the path of the electron beam.

While the basic operational principles of x-ray devices have remained substantially unchanged, new uses and applications for x-rays have increased the performance demands placed on x-ray tubes. One response to such demands has resulted in the development of anodes that have increasingly larger sizes and/or that are suited for relatively higher operational speeds. While such anodes generally facilitate a desirable increase in the overall performance of the x-ray tube, the increased size and/or speed of those anodes often can cause other undesirable problems with respect to other portions of the x-ray tube. An area of particular concern in this regard is the mounting system used to rotatably support the anode.

In general, the quality of the images produced by a particular device is at least partially a function of the stability of the anode. In particular, image quality can depend on the changes in the relative position of the focal spot, or the point at which the electrons strike the target. Any migration of the focal spot due to vibration or other instabilities can reduce the image quality of the x-ray tube. Thus, the anode mounting system must be constructed and implemented in such a way that balanced mounting of the anode can be achieved and maintained, and undesirable movement of the anode during x-ray tube operation thereby minimized or prevented. As suggested above however, such results are not achieved in all cases due to relative increases in the size and weights of anodes now in use, the operational speeds at which such anodes are employed, and/or the extreme thermal stresses imposed on the anode and its mounting system.

In particular, the weights and operational speeds of many anodes can cause various components of the anode mounting system to loosen over time. This effect may be further exacerbated by thermal effects resulting from the high temperature operating environment typical of x-ray devices. Further, anodes typically accelerate at a high rate of revolutions per minute to achieve an operational speed. Such high rates of acceleration introduce various mechanical stresses and strains that often compromise the integrity of the anode mounting system components, and may cause such components to loosen over a period of time.

A related concern with anode mounting systems deals with the extent to which they can be disassembled. In particular, it is often desirable to remove an anode from an x-ray tube after a given amount of operating time, and then recondition and re-install the anode. Removal may also be needed to access other x-ray tube components. However, removal of the anode from the x-ray tube, has often proven difficult. These difficulties are often associated with the configuration and layout of the anode mounting system.

For example, some x-ray tubes employ an anode mounting system that includes a bearing assembly and stationary shaft configured so that so that the anode, rotatably supported by the bearing assembly, rotates about the stationary shaft. In such arrangements, the stationary support shaft is typically mounted to the vacuum enclosure within an aperture or sleeve. In such a configuration, a braze joint usually serves to secure the stationary shaft to the vacuum enclosure and also to seal the vacuum enclosure. This configuration can be especially difficult to disassemble. This is due in large part to the manner by which the stationary shaft is mounted to the vacuum enclosure. To maintain rigid support for the anode, the fit between the sleeve and the support shaft must be extremely tight. Typically, this is achieved with an interference fit, where the sleeve, for example, is heated while the shaft is cooled. Due to the expansion of the sleeve and the contraction of the shaft, the shaft can be inserted into the sleeve. As the two components reach thermal equilibrium, the gap between the shaft and sleeve is eliminated, resulting in a tight fit between the two.

While this is effective in tightly fitting the shaft and sleeve together, it also creates a bond between the sleeve and the support shaft that is very difficult to break. Further, when the bond is broken, damage may occur to the shaft, sleeve, anode, and/or vacuum enclosure. Consequently, disassembly can result in added expense when repairing or replacing tube components and may even render the entire x-ray tube inoperable. While it may be possible in some instances to minimize the damage that may occur during separation of the shaft and sleeve, the processes necessary to achieve such results are typically expensive and time consuming.

In view of the foregoing, and other, problems in the art, a need exists for a rotary component support system that securely and reliably supports the anode in a desired position under a variety of operating conditions. In addition, it would be an advancement to provide a support system that is configured to be readily and non-destructively disassembled, thereby facilitating repair or maintenance of the anode or other components located within the vacuum enclosure.

BRIEF SUMMARY OF VARIOUS FEATURES OF THE INVENTION

The present invention has been developed in response to the current state of the art, and in particular, in response to these and other problems and needs that have not been fully or adequately addressed. Briefly summarized, embodiments of the present invention are directed to a rotary component support system that securely and reliably supports a component in a desired position under a variety of operating conditions, and that is configured to be readily and non-destructively disassembled.

Embodiments of the invention are particularly useful in anode grounded x-ray tubes, such as are commonly employed in computerized tomography ("CT") and other medical applications. In general however, embodiments of the invention are suitable for use in any application where it is desired to securely and reliably support a rotatable component in a desired position under a variety of operating conditions, and where it is desired to reduce or minimize the cost and expense associated with the disassembly of the rotary component support system.

Embodiments of the rotary component support system are suitable for use in conjunction with a bearing assembly having a rotatable cylinder to which an anode is mounted. The rotatable cylinder is arranged for rotary motion about a stationary support shaft so that as the cylinder rotates, the anode that is mounted to the cylinder rotates about the support shaft.

The support shaft of the rotary component support system, as well as the anode and bearing assembly, are disposed within the vacuum enclosure of an x-ray tube. In one preferred embodiment, one end of the support shaft is disposed within the bearing assembly. The other end of the support shaft defines a threaded cavity and is tapered on the outside so that it can be received within a mounting piece having a corresponding geometry. The mounting piece is preferably welded within an aperture that is formed through a wall of the x-ray tube housing that defines the vacuum enclosure. Generally, the mounting piece defines a cavity having a taper that corresponds to the geometry of the taper of the support shaft. Also, a threaded hole is formed through a center portion of the mounting piece. A bolt passes through and engages the threaded hole of the mounting piece. The length of the bolt allows it to extend through the hole of the mounting piece so as to likewise engage the threaded cavity defined by the support shaft.

To assemble the rotary component mounting system, the bolt is tightened so that the support shaft is drawn into the mounting piece until the tapered end of the support shaft is seated within the tapered cavity defined by the mounting piece. Sealing of the vacuum enclosure is accomplished by placing a weld at the interface between the bolt and mounting piece.

Because the mounting piece and support shaft have corresponding tapered geometries, the shaft can be readily and quickly aligned with the mounting piece without the need for time consuming adjustments. Alignment of the shaft contributes to the elimination of vibration and other undesirable phenomena often associated with unbalanced rotating components. Further, the bolt cooperates with the tapered geometries of the mounting piece and shaft to facilitate ready separation of the mounting piece and shaft should such a need arise. In particular, the weld on the interface between the bolt and mounting piece can be easily ground off, or otherwise removed, so that disassembly is accomplished by removing the bolt and pulling the mounting piece and support shaft apart from each other.

These and other advantages and features of the present invention will become more fully apparent from the following description and appended claims.

BRIEF DESCRIPTION OF THE DRAWINGS

To further clarify the above and other advantages and features of the present invention, a more particular description of the invention will be rendered by reference to specific embodiments thereof that are illustrated in the appended drawings. These drawings depict only exemplary embodiments and are, therefore, not to be considered as limiting the scope of the invention in any way. The invention will be described and explained with additional specificity and detail through the use of the accompanying drawings in which.

DETAILED DESCRIPTION OF VARIOUS EMBODIMENTS

Reference will now be made to figures wherein like structures will be provided with like reference designations. It is understood that the drawings are diagrammatic and schematic representations and are not necessarily drawn to scale. Moreover, the drawings merely illustrate examples of presently preferred embodiments, and are not limiting with respect to the scope of the present invention.

Figure 1:
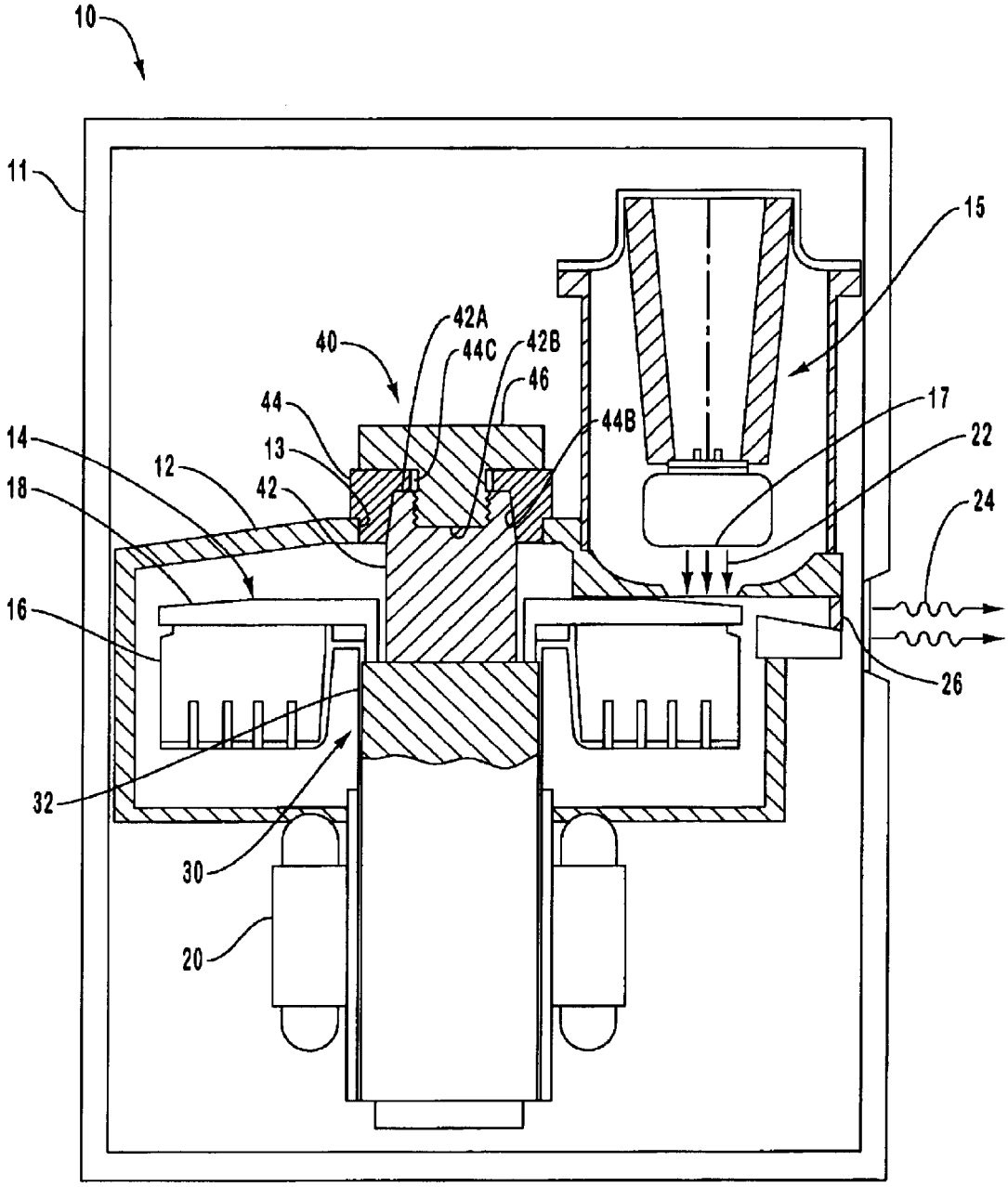
FIG. 1 is a cross-sectional side view of illustrating various features of an embodiment of a rotary component support system employed in an exemplary operating environment, specifically, an x-ray tube.

Reference is first made to FIG. 1, which illustrates selected features of an x-ray tube, designated generally at 10. In this embodiment, the x-ray tube 10 comprises an anode grounded type x-ray tube such as may be employed in CT applications. However, embodiments of the invention are suitable for use with other types of x-ray tubes, and in various other devices as well. Accordingly, the scope of the present invention should not be construed to be limited to this exemplary operating environment.

The x-ray tube 10 includes a housing 11 within which is disposed a housing defining a vacuum enclosure 12. Disposed within the vacuum enclosure 12 is an anode assembly 14 and a cathode assembly 15. The anode 14 includes a substrate 16 upon which a target surface 18 is disposed. The target surface 18 is spaced apart from the electron emitting portion (filament) 17 of the cathode 15. In general, a bearing assembly 30, having a support sleeve 32 to which anode 14 is mounted, and a rotary component support system 40, discussed in greater detail below, cooperate to position and rotatably support the anode 14 within the vacuum enclosure 12. Finally, a stator 20 portion of an inductive motor is used to induce high speed rotary motion of support sleeve 32 to which anode 14 is mounted.

In operation, the filament portion 17 of the cathode 15 is connected to a suitable power source (not shown), to supply an electrical current to the filament. This causes electrons, designated at 22, to be emitted from the filament surface by the process of thermionic emission. A high voltage potential is applied between the anode 14 and the cathode 15, which causes the emitted electrons 22 to accelerate rapidly toward the target surface 18 of the rotating anode 14.

As the electrons 22 accelerate, they gain a substantial amount of kinetic energy. Upon approaching and impacting the target surface 18 of the anode 14, some of this kinetic energy is released in the form of electromagnetic waves of very high frequency, i.e., x-rays. The resulting x-rays, designated at 24, emanate from the target surface 18 and are then collimated through a window 26 for penetration into an object, such as the body of a patient. The x-rays 24 that pass through the object can be detected, analyzed, and used in any one of a number of applications, such as x-ray medical diagnostic imaging or materials analysis procedures.

Figure 2:
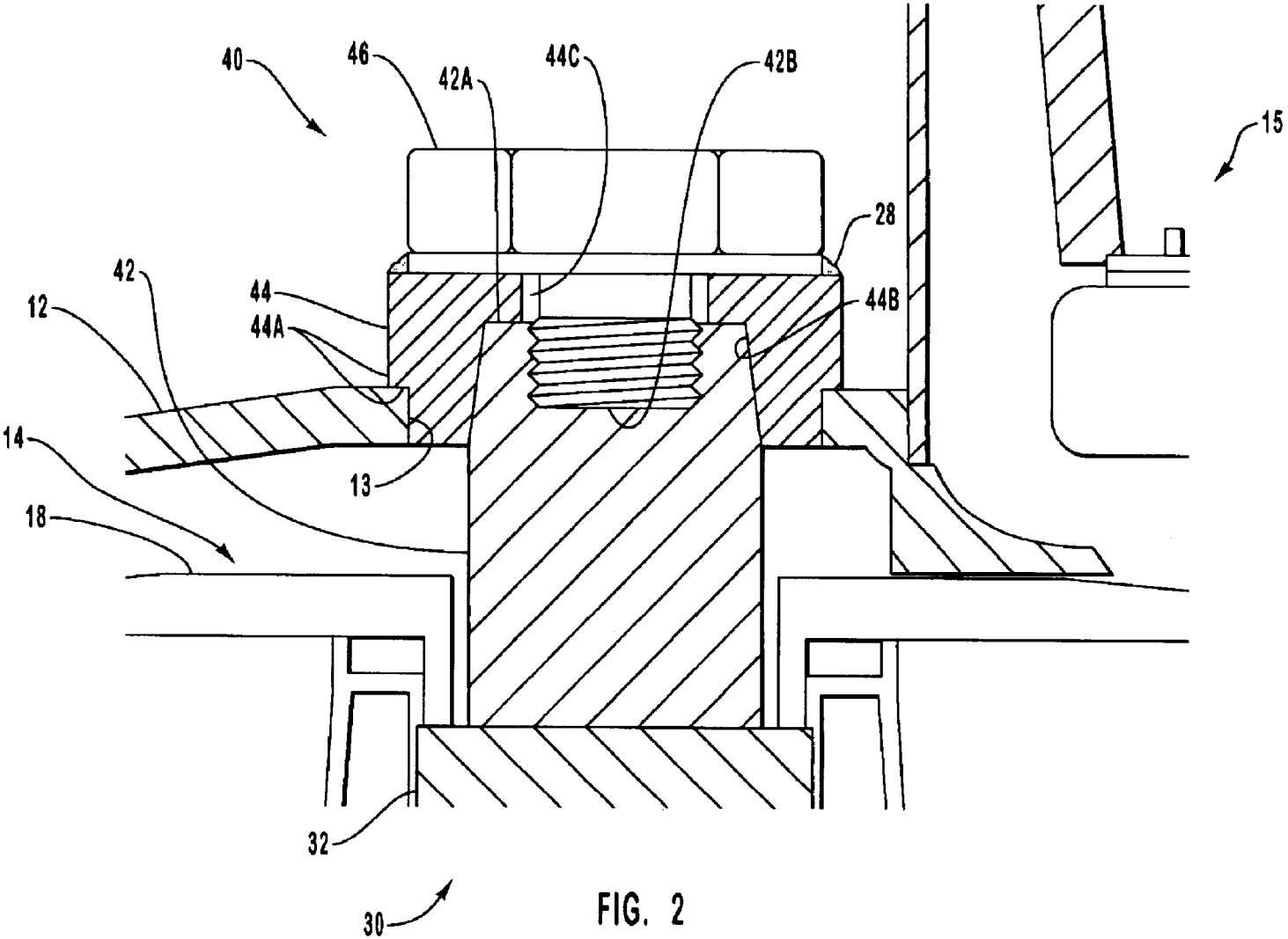
FIG. 2 is a partial cross-sectional side view illustrating additional details of the embodiment of the rotary component support system depicted in FIG. 1.

Directing attention now to FIG. 2, and with continuing reference to FIG. 1, details are provided concerning various features of an embodiment of the rotary component support system, designated generally at 40. The rotary component support system 40 serves to, among other things, maintain rotating anode 14 in a desired position and orientation with respect to cathode 15, under a variety of operating conditions.

In a preferred embodiment, the rotary component support system 40 comprises a support shaft 42, about which support sleeve 32 and anode 14 rotate. In addition, the support system 40 includes a mounting piece 44 and a bolt 46. The shaft 42 may be solid, or may alternatively be at least partially hollow so as to provide a desired thermal conduction characteristic. Furthermore, the mounting piece 44 and the bolt 46 are preferably composed of any of a variety of stainless steels, such as 304L stainless steel, and are produced using various techniques such as machining. The support shaft 42 is also preferably composed of any of a variety of stainless steels, such as 1018 stainless steel. The foregoing materials are exemplary only, and support shaft 42, mounting piece 44 and/or bolt 46 may comprise any other material(s) having properties suited to the particular operating environment in which rotary component support system 40 is employed. In an alternative embodiment, the mounting piece 44 may be formed integrally with the wall of the vacuum enclosure 12.

With continuing reference to FIG. 2, the support shaft 42 includes a tapered end 42A that includes a threaded hole 42B formed at least partially therein. The type of threading, as well as variables such as the depth and width of threaded hole 42B, may be varied as necessary to suit the requirements of a particular application. Further, variables such as, but not limited to, the angle and length of the taper may be varied as required to suit a particular application. In some cases, the taper angle of the tapered end 42A of the support shaft 42 and the taper angle of the cavity 44B are made to vary from each other slightly. In general, the relationship between the taper at the tapered end 42A of support shaft 42 and the taper of mounting piece 44, discussed below, should be such as is necessary to provide the functionality disclosed herein. Also, it will be appreciated that while in the illustrated embodiment the complementary fit between the end of the support shaft and the corresponding cavity in the mounting piece is shown as a taper, the present invention should not be limited to that particular geometry. In fact, any one of a number of other complementary geometries could also be used.

As suggested above, radial and axial support for the tapered end 42A of support shaft 42 is provided by a mounting piece 44. In the illustrated embodiment, the mounting piece 44 resides in an aperture 13 that is defined through the wall of the housing forming the vacuum enclosure 12. The mounting piece 44 includes a lip 44A that contacts the outside of the vacuum enclosure 12 when the mounting piece 44 is disposed within the aperture 13. Other embodiments of the invention may include a mounting piece 44 that lacks lip 44A and resides completely within the aperture 13. In general however, any configuration of mounting piece 44 that provides the functionality disclosed herein may be employed. Finally, the mounting piece 44 is attached to the vacuum enclosure 12 by processes such as welding or brazing.

In the illustrated embodiment, the mounting piece 44 has a generally cylindrical shape, although any other suitable shape could be used. The interior portion of the mounting piece defines a cavity 44B that has a geometry that is generally complementary to that of tapered end 42A of support shaft 42. Preferably, cavity 44B is shaped to closely receive at least a portion of tapered end 42A. As in the case of tapered end 42A, variables such as, but not limited to, the angle and length of the taper of cavity 44B may be varied as required to suit a particular application. As indicated in FIG. 2, cavity 44B communicates with a hole 44C which is aligned with threaded hole 42B of support shaft 42 when support shaft 42 is received in mounting piece 44. As discussed below, a threaded bolt 46 serves to securely retain the support shaft 42 to the mounting piece 44.

As is shown, a bolt 46 is inserted into the hole 44C of mounting piece 44 and rotated so that the threads of bolt 46 engage the corresponding threads of the hole 44C. The length of the threaded section of the bolt 46 allows it to also engage the threads of the threaded hole 42B of the support shaft 42. As the bolt is tightened, it draws the tapered end 42A of support shaft 42 into the cavity 44B of the mounting piece 44. The bolt 46 can be tightened until the tapered end 42A of support shaft 42 is fully received within cavity 44B of mounting piece 44 and the end of support shaft 42 is seated on the bottom of cavity 44B. Alternatively, mounting piece 44 and/or support shaft 42 may be configured so that support shaft 42 occupies only a portion of cavity 44B. Also, in alternative embodiments, the hole 44C could be threaded so as to engage with the threads of bolt 46.

When the bolt 46 is tightened as described above, the tapered surfaces of the support shaft 42 and the mounting piece 44 cooperate to ensure that the support shaft 42 is centered with respect to the mounting piece 44. In this way, the anode 14, mounted for rotation about support shaft 42, is also properly oriented and positioned within the vacuum enclosure 12. Thus, one advantage of the construction of support shaft 42 and mounting piece 44 is that support shaft 42 is self-aligning with respect to mounting piece 44 so that the time consuming alignment process often associated with interference fit joining techniques is eliminated. Furthermore, because only a single bolt 46 is employed, the joining and aligning of support shaft 42 with respect to mounting piece 44 can be accomplished relatively quickly. Yet another advantage of embodiments of the invention is that vibration and other phenomena often associated with unbalanced rotating components is materially reduced.

In an alternative embodiment, the physical configuration of mounting piece 44 and support shaft 42 can be altered to achieve substantially the same effect. For example, the support shaft 42 can define a tapered cavity in communication with a threaded hole. Similarly, mounting piece 44 comprises a tapered portion, or plug, that includes a hole formed through it. Joining of the mounting piece 44 and support shaft 42 in this embodiment is achieved by way of a bolt 46 that passes through the hole of the tapered plug and engages the threads of the threaded hole defined by the support shaft 42. Thus, as bolt 46 is tightened, the tapered cavity of shaft 42 is drawn up and around the tapered plug of the mounting piece 44.

After the support shaft 42 is in the desired position, a seal 28 can then be disposed about the interface between bolt 46 and mounting piece 44. In some embodiments of the invention, the seal 28 comprises a weld joint such as a piece-to-piece weld, or a weld joint that utilizes an intermediate filler material. The seal 28 serves to prevent loss of the vacuum present in vacuum enclosure 12 due to gaps that may exist between the support shaft 42, the mounting piece 44 and/or the bolt 46.

The separation of support shaft 42 and mounting piece 44 can be accomplished by grinding or machining off the seal 28, in the case where seal 28 comprises a weld joint. The bolt 46 can then be loosened until the support shaft 42 separates from mounting piece 44. In this way, separation of support shaft 42 from mounting piece 44 can be accomplished quickly and without causing damage to either component, or to other components of x-ray tube 10. Consequently, embodiments of the invention serve to, among other things, enhance the ease with which maintenance of anode 14, or other components, can be accomplished, while also reducing costs by minimizing damage to x-ray tube 10 during separation of support shaft 42 and mounting piece 44. Additionally, the secure positioning and centering of the anode 14, implemented by embodiments of the present invention serves to substantially foreclose problems caused by thermal and mechanical stresses, such as unbalanced rotation of the anode 14 and relative movement between the components which hold the support shaft in place.

Figure 3:
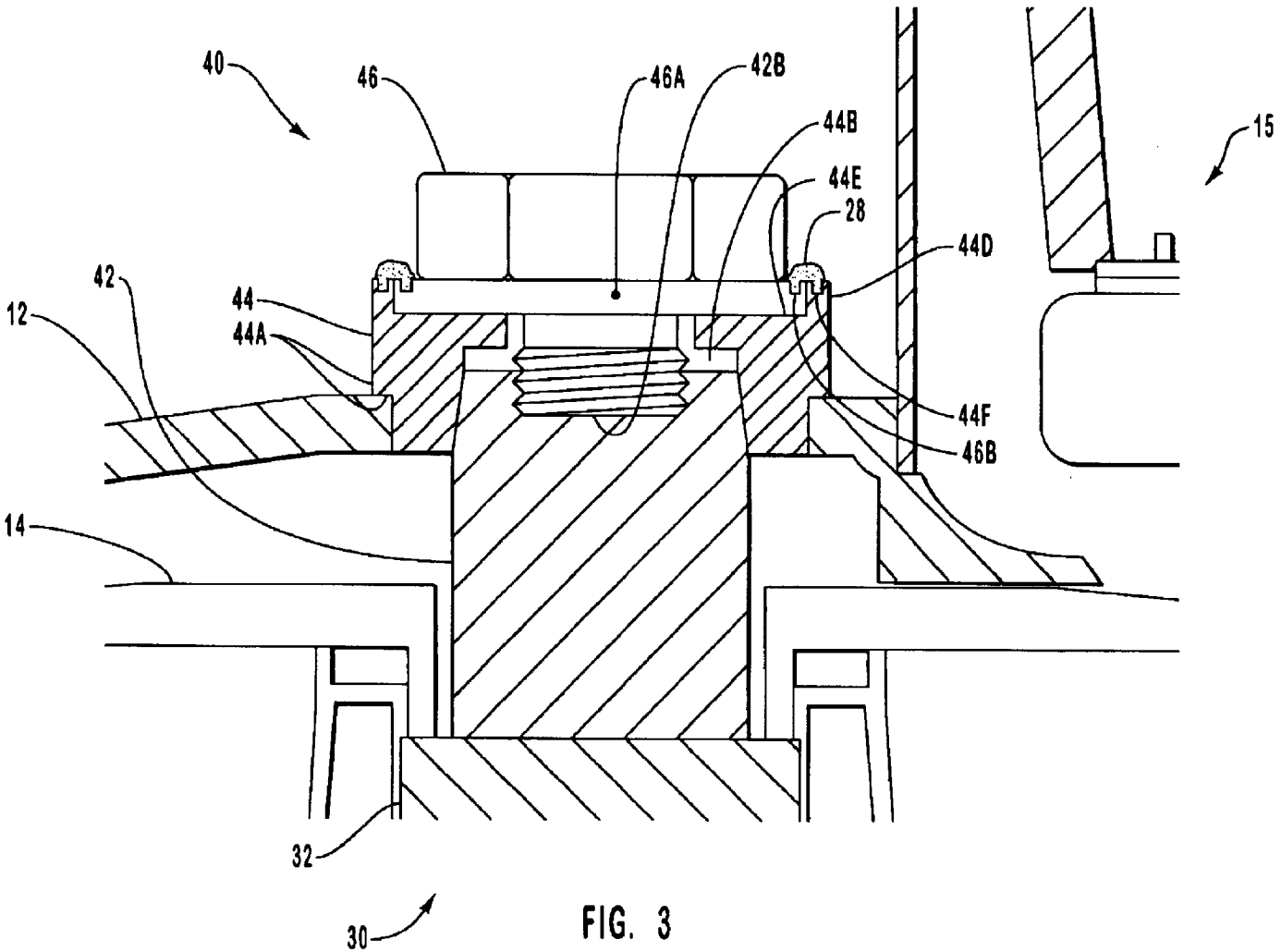
FIG. 3 is a partial cross-sectional side view illustrating various details of another embodiment of the rotary component support system.

Reference is now made to FIG. 3, where various features of yet another embodiment of the rotary component support system 40 are illustrated. Because various features of the embodiment illustrated in FIG. 2 are also present in the embodiment illustrated in FIG. 3, the following discussion will not address those common features and will instead focus primarily on selected differences between such embodiments.

In the embodiment illustrated in FIG. 3, mounting piece 44, while generally similar to the embodiment illustrated in FIG. 2, further includes an annular lip 44D formed about the outer periphery of the top surface of the mounting piece 44 so as to define a recess 44E. This recess 44E is sized to receive a flange 46A of the bolt 46. The flange 46A in this embodiment defines an annular channel 46B which abuts a corresponding annular channel 44F defined by annular lip 44D. A seal 28, such as a weld joint, disposed on the interface between channels 46B and 44F serves to prevent loss of the vacuum present in vacuum enclosure 12 due to gaps that may exist between the support shaft 42, the mounting piece 44 and/or the bolt 46.

With continuing reference to FIG. 3, note that the end of the support shaft 42 need not fully occupy the cavity 44B defined by mounting piece 44, but may, in some embodiments, occupy only a portion of the cavity 44B. Similarly, various other modifications to the respective geometries of the rotary component support system 40 components may be employed as required to suit a particular application and/or to facilitate the manufacturing process.

The present invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. A x-ray tube, comprising:

(a) a vacuum enclosure defining an aperture and having disposed therein a rotary anode and a cathode, the anode being arranged to receive electrons emitted by the cathode; and (b) a rotary component mounting system comprising:

(i) a shaft rotatably mounted to the anode, one end of the shaft having a predetermined geometric shape and a threaded hole formed proximate to the shaped end;

(ii) a mounting piece disposed within the aperture defined by the vacuum enclosure, the mounting piece including a shaped portion having a geometric shape that is configured to substantially engage the shaped end of the shaft; and (iii) a bolt, a portion of the bolt being received through a hole formed through the mounting piece so as to operatively engage the threaded hole of the shaft.

2. The x-ray tube as recited in claim 1, wherein the anode is rotatably mounted to the shaft via a bearing assembly.

3. The x-ray tube as recited in claim 1, further comprising a seal disposed on the bolt and the mounting piece.

4. The x-ray tube as recited in claim 3, wherein the seal comprises a weld.

5. The x-ray tube as recited in claim 1, wherein the shaped portion defined by the mounting piece comprises a tapered cavity.

6. The x-ray tube as recited in claim 5, wherein the shaped end of the shaft comprises a tapered portion.

7. The x-ray tube as recited in claim 1 wherein the anode is arranged for rotation about the support shaft.

8. In an x-ray tube having a vacuum enclosure that defines an aperture, and a cathode and an anode disposed within the vacuum enclosure, a rotary component support system, comprising:

(a) a shaft adapted for at least indirect mounting of the anode thereto, one end of the shaft being tapered and defining a threaded hole;

(b) a mounting piece disposed within the aperture defined by the vacuum enclosure and defining a tapered cavity configured to engage at least a portion of the tapered end of the shaft; and (c) a bolt at least partially disposed within the tapered cavity defined by the mounting piece and engaged with the threaded hole defined by the shaft.

9. The rotary component mounting system as recited in claim 8, wherein the mounting piece further defines a hole in communication with the tapered cavity, the bolt being received through the hole.

10. The rotary component mounting system as recited in claim 8, further comprising a seal disposed on an interface between the bolt and the mounting piece.

11. The rotary component mounting system as recited in claim 10, wherein the seal comprises a weld.

12. The rotary component support system as recited in claim 10, wherein at least one of the mounting piece, the bolt, and the support shaft comprises stainless steel.

* * * * *

UNITED STATES PATENT AND TRADEMARK OFFICE

CERTIFICATE OF CORRECTION

PATENT NO. : 6,751,293 B1
DATED : June 15, 2004
INVENTOR(S) : Vaughn Leroy Barrett It is certified that error appears in the above-identified patent and that said Letters Patent is hereby corrected as shown below:

Column 1,
Line 62, after "contained" insert -- in --.

Column 8,
Line 51, after "on" insert -- an interface between --.

Signed and Sealed this

Fourteenth Day of March, 2006

JON W. DUDAS
*Director of the United States Patent and Trademark Office*